US008735710B2

(12) United States Patent
Yamabata

(10) Patent No.: US 8,735,710 B2
(45) Date of Patent: May 27, 2014

(54) ELECTRONIC STRINGED INSTRUMENT HAVING EFFECT DEVICE

(71) Applicant: Roland Corporation, Shizuoka-ken (JP)

(72) Inventor: Toshio Yamabata, Hamamatsu (JP)

(73) Assignee: Roland Corporation, Hamamatsu (JP)

( * ) Notice: Subject to any disclaimer, the term of this patent is extended or adjusted under 35 U.S.C. 154(b) by 0 days.

(21) Appl. No.: 13/745,659

(22) Filed: Jan. 18, 2013

(65) Prior Publication Data

US 2013/0205978 A1 Aug. 15, 2013

Related U.S. Application Data

(60) Provisional application No. 61/597,636, filed on Feb. 10, 2012.

(51) Int. Cl.
*G10H 3/26* (2006.01)
*G10H 3/18* (2006.01)

(52) U.S. Cl.
USPC ..... 84/627; 84/626; 84/663; 84/702; 84/738

(58) Field of Classification Search
USPC ..... 84/626, 627, 663, 702, 738
See application file for complete search history.

(56) References Cited

U.S. PATENT DOCUMENTS 1,893,895 A * 1/1933 Hammond, Jr. ..... 84/723
2,001,723 A * 5/1935 Hammond, Jr. ..... 84/723
3,535,972 A * 10/1970 Teranishi ..... 84/678
3,571,480 A * 3/1971 Tichenor et al. ..... 84/723
3,612,741 A * 10/1971 Marshall ..... 84/723
3,677,124 A * 7/1972 O'Brien ..... 84/258
3,742,113 A * 6/1973 Cohen ..... 84/726
4,075,921 A * 2/1978 Heet ..... 84/738
D248,122 S * 6/1978 Heet ..... D17/21
4,236,433 A * 12/1980 Holland ..... 84/726
4,245,540 A * 1/1981 Groupp ..... 84/726
4,248,120 A * 2/1981 Dickson ..... 84/726
4,697,491 A * 10/1987 Maloney ..... 84/723
4,852,444 A * 8/1989 Hoover et al. ..... 84/738
4,858,508 A * 8/1989 Shibukawa ..... 84/604
4,907,483 A * 3/1990 Rose et al. ..... 84/726
4,941,388 A * 7/1990 Hoover et al. ..... 84/726
4,982,644 A * 1/1991 Shibukawa ..... 84/627
5,054,361 A * 10/1991 Usa ..... 84/737

(Continued)

FOREIGN PATENT DOCUMENTS

JP 06-25898 4/1994

OTHER PUBLICATIONS

English machine translation of JP06-25898, Apr. 8, 1994 by Roland Corporation.

*Primary Examiner* — David S. Warren
(74) *Attorney, Agent, or Firm* — Konrad Raynes Davda & Victor LLP; David W. Victor

(57) ABSTRACT

Provided is an electronic stringed instrument comprising: a pickup that detects vibration of a string; a feedback operator used to select a level of feedback effect; a feedback control device that controls to add a feedback effect to a tone signal based on the vibration of the string detected by the string vibration detection device and based on the selected level of feedback effect from the feedback operator; and an output device that outputs the tone signal to which the feedback effect is added by the feedback control device.

21 Claims, 8 Drawing Sheets

(56) References Cited

U.S. PATENT DOCUMENTS

| | | | | | |
|---|---|---|---|---|---|
| 5,070,759 | A * | 12/1991 | Hoover et al. | 84/726 |
| 5,123,324 | A * | 6/1992 | Rose et al. | 84/726 |
| 5,200,569 | A * | 4/1993 | Moore | 84/723 |
| 5,233,123 | A * | 8/1993 | Rose et al. | 84/726 |
| 5,278,350 | A * | 1/1994 | Okamoto et al. | 84/658 |
| 5,288,940 | A * | 2/1994 | Izumisawa | 84/603 |
| 5,292,999 | A * | 3/1994 | Tumura | 84/728 |
| 5,378,850 | A * | 1/1995 | Tumura | 84/727 |
| 5,449,858 | A * | 9/1995 | Menning et al. | 84/727 |
| 5,523,526 | A * | 6/1996 | Shattil | 84/728 |
| 5,585,588 | A * | 12/1996 | Tumura | 84/726 |
| 5,932,827 | A * | 8/1999 | Osborne et al. | 84/726 |
| 6,034,316 | A * | 3/2000 | Hoover | 84/738 |
| 6,348,791 | B2 * | 2/2002 | Shattil | 324/225 |
| 7,453,040 | B2 * | 11/2008 | Gillette | 84/723 |
| 7,678,988 | B2 * | 3/2010 | Sato et al. | 84/743 |
| 7,786,374 | B2 * | 8/2010 | Valli et al. | 84/737 |
| 8,067,683 | B2 * | 11/2011 | Meeks et al. | 84/622 |
| 2002/0069749 | A1 * | 6/2002 | Hoover et al. | 84/738 |
| 2005/0081703 | A1 * | 4/2005 | Hoover | 84/726 |
| 2009/0320671 | A1 * | 12/2009 | Meeks et al. | 84/735 |
| 2013/0205978 | A1 * | 8/2013 | Yamabata | 84/616 |

* cited by examiner

ELECTRONIC STRINGED INSTRUMENT HAVING EFFECT DEVICE

CROSS-REFERENCE TO RELATED APPLICATION

This application claims the benefit of U.S. Provisional Application No. 61/597,636, filed Feb. 10, 2012, which Provisional Application is incorporated by reference in its entirety.

BACKGROUND OF THE INVENTION

1. Field of the Invention

The present invention relates to electronic stringed instrument having effect devices.

2. Description of the Related Art

An important performance technique for the electric guitar, which is one of the stringed instruments, is feedback performance. In the feedback performance, the performer strikes (plucks) the strings of the electric guitar, and then the performer moves the electric guitar, while the strings are still vibrating, close to a loudspeaker of a guitar amplifier that is amplifying musical tones based on the plucking of the strings and emanating sounds of the amplified tones. By carrying out this operation, a feedback loop is formed from the strings of the electric guitar, the loudspeaker and the acoustic space between them. In this feedback loop, the strings being plucked are further vibrated by resonance caused by the musical tones (musical tones based on plucking of the strings) emanated from the loudspeaker, whereby the feedback performance can be realized.

However, the feedback performance is a performance technique that requires subtle control in, for example, the manner and the strength in which the strings are plucked, the distance between the strings and the loudspeaker, the direction and timing in which the strings are moved closer to the loudspeaker, the sound volume (output level) of musical tones emanated from the loudspeaker and the like, which is a very difficult performance technique for the musicians. Therefore, the performers often fail in the feedback performance.

Japanese Utility Model Patent Application HEI 6-25898 ("JP Application HEI 6-25898") describes an effect device that detects the pitch of a musical tone pronounced by plucking the strings, and sets a band-pass filter to pass only the frequency components in a predetermined passband width in which the frequency corresponding to the detected pitch is assumed to be a center frequency.

According to the effect device described in JP Application HEI 6-25898, the musical tone with a desired pitch pronounced by plucking the strings (that is, in the electric guitar, the musical tone with a pitch that is specified by the performer by pressing the strings against the fret, and may be referred to as the "fundamental (fundamental tone)" or the "keynote") in which the frequency component of the musical tone is emphasized can be output and, as a result, the vibration of the strings can be continued with the frequency of the fundamental.

SUMMARY

Provided is an electronic stringed instrument comprising: a pickup that detects vibration of a string; a feedback operator used to select a level of feedback effect; a feedback control device that controls to add a feedback effect to a tone signal based on the vibration of the string detected by the string vibration detection device and based on the selected level of feedback effect from the feedback operator; and an output device that outputs the tone signal to which the feedback effect is added by the feedback control device.

Further provided is an electronic stringed instrument used by a performer, comprising: a string vibration detection device that detects vibration of a string; an effect adding device that adds a predetermined effect to a string signal detected by the string vibration detection device; and a touch detection part that detects a touch by a performer, wherein the effect adding device is turned on when the touch by the performer is detected and a result of the detecting is ON.

Further provided is an electronic stringed instrument comprising: a string vibration detection device that detects vibration of a string; an effect adding device that adds a predetermined effect to a string signal detected by the string vibration detection device; and a touch detection part that detects a touch by a performer, wherein the effect by the effect adding device is switched on/off, when the touch by the performer is detected and a result of the detecting is ON.

Further provided is an electronic stringed instrument used by a performer, comprising: a string vibration detection device that detects vibration of a string; an effect adding device that adds a predetermined effect to a string signal detected by the string vibration detection device; a touch detection part that detects a touch by the performer; and an indicator that visually displays on/off of the effect, wherein the effect by the effect adding device is switched ON, when the touch by the performer is detected and a result of the detecting is ON, and the display state of the indicator is changed.

Further provided is an effect device comprising: an input device to which a tone signal based on vibration of strings of a stringed instrument is input; a filter device that passes the tone signal from the input device; a pitch detection device that detects a pitch of the tone signal from the filter device and/or a pitch of the tone signal to be input to the filter device; an output device that outputs the tone signal output from the filter device; a feedback switch that is capable of switching the feedback effect on and off; and a setting device that sets a parameter of the filter device corresponding to the pitch detected by the pitch detection device when the feedback switch is turned on, and that resets a parameter of the filter device corresponding to the pitch detected by the pitch detection device if the difference of the pitches between the pitch detected by the pitch detection device and the pitch that was used to determine the current parameter of the filter device is greater than a predetermined value.

Further provided is an effect device comprising: an input device receiving a tone signal based on vibration of strings of a stringed instrument; a filter device that passes the tone signal input from the input device; a pitch detection device that detects a pitch of the tone signal input from the filter device and/or a pitch of the tone signal to be input to the filter device; an output device that outputs the tone signal output from the filter device; a feedback switch that is capable of switching on and off of the feedback effect; a setting device that sets a parameter of the filter device corresponding to the pitch detected by the pitch detection device when the feedback switch is turned on, and that re-sets a parameter of the filter device corresponding to the pitch detected by the pitch detection device if the difference of the pitches between the pitch detected by the pitch detection device and the pitch that was used to determine the current parameter of the filter device is greater than a predetermined value; a level detection device that detects a level of the tone signal output from the filter device and/or a level of the tone signal to be input in the filter device; and a level control device that controls the level of the tone signal output outside from the output device to have a level corresponding to the level detected by the level detection device.

BRIEF DESCRIPTION OF THE DRAWINGS

FIG. 2(*b*) is a functional block diagram showing the functions of the electronic guitar.

DETAILED DESCRIPTION

Figure 1:
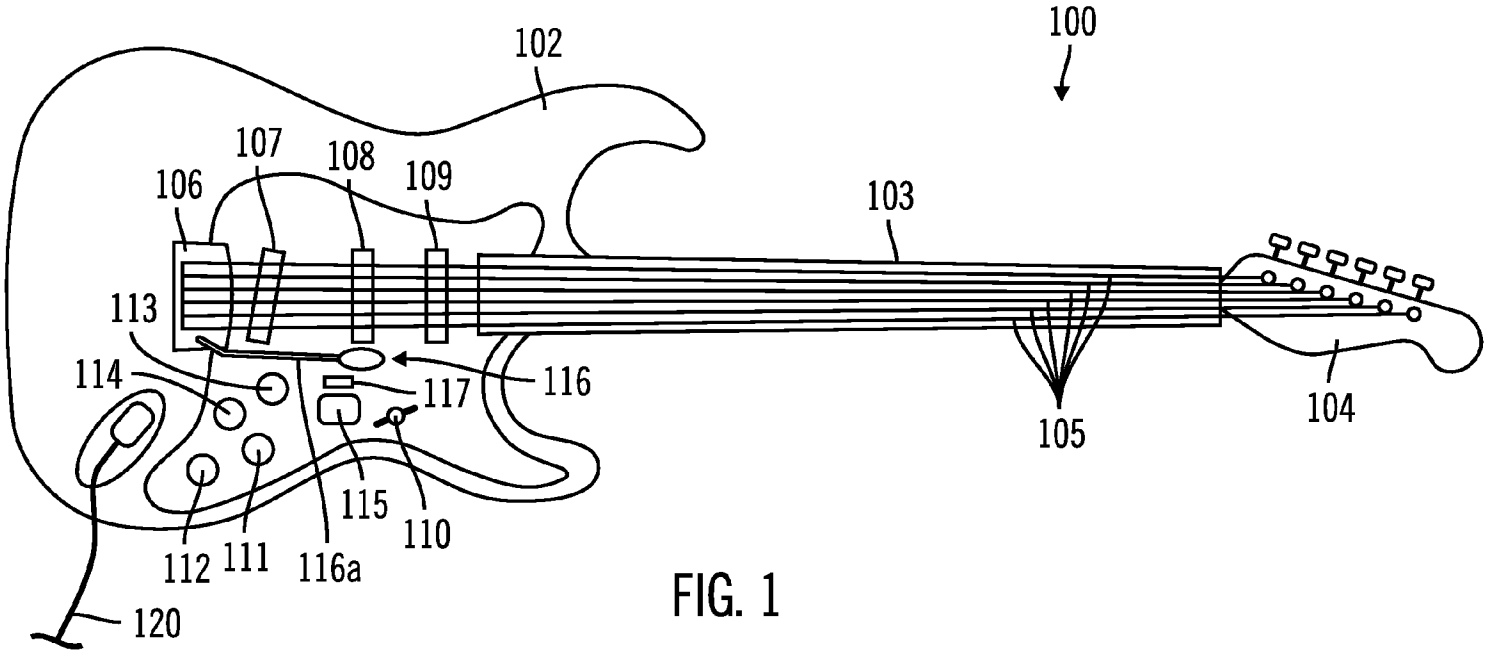
FIG. 1 is a front view showing an electronic guitar in accordance with an embodiment of the invention.

Even by using the effect device described in JP Application HEI 6-25898, the level of feedback sound is naturally attenuated such that the vibration of the strings of the stringed instrument cannot be stably maintained, or more intense feedback (howling) that becomes unpleasant noise and is different from what the performer intended may result, and therefore there was room for a further improvement.

To counter this problem, it is conceivable to control the level of a tone signal to be output outside according to the level of the tone signal acquired after it has passed a filter or before it passes the filter. According to the effect device that performs such control, the vibration of the guitar strings can be stably maintained by performing automatic control according to the level of the feedback sound, whereby the feedback performance can be done much easier. Moreover, by a composition in which parameters of a filter that passes the tone signal generated based on plucking are set according to the detected pitch of the tone signal, the tone signal with a frequency characteristic suitable for the feedback performance can be output, such that suitable feedback performance can be carried out with ease.

However, because the conventional effect device is composed as an independent unit, it is necessary to connect the electric guitar, the effect device, and the amplifier together one by one in the correct order, and it took time for the installation (setting), which is cumbersome.

Moreover, it is difficult to change the setting of the effect during performance, when the effect device is a floor installation type effector operated with the pedal. Therefore, for example, it is not possible to respond to the demand for feedback effects with a different setting in a series of tunes. Moreover, because the feedback effect changes depending on the volume and the tone (for instance, tone setting of the guitar, etc.), and the direction of the guitar at the moment, there is a demand for fine-tuning the effect according to the situation. However, such a demand cannot be met in the floor installation type effector. In addition, the performer needs to be at the position where the performer can operate the pedal. Therefore, the standing position of the performer is limited, and the limitation is imposed on the staging and the performance.

How the feedback effect occurs greatly differs depending on the distance between the performer and the amplifier (speaker) and their positional relation. Therefore, even if the restriction that requires the performer to be at the position where the performer can operate the pedal is cancelled, and even if the performer can operate the floor installation type effector while performing at any arbitrary positions, the performer needs to change the setting properly according to the performance position in order to achieve the best feedback effect.

The described embodiments provide an electronic stringed instrument by which feedback performance can be easily performed, compared to the case where an effect device for adding feedback effect is provided as an independent unit.

An electronic stringed instrument in accordance with an embodiment of the invention includes: a pickup that detects vibration of strings; a feedback operator that can be arbitrarily operated; a feedback control device that controls to give feedback effect, based on the operation of the feedback operator, to tone signal based on the vibration of the strings detected by the pickup; and an output device that outputs the tone signal with the feedback effect added by the feedback control device. Because the electronic stringed instrument described above is provided with the feedback operator installed thereon, the performer can add feedback effect to the tone signal generated based on the vibration of the strings by operating the feedback operator. Therefore, according to certain described embodiments, the performer can easily perform the feedback performance in an arbitrary part of a music tune being performed, compared with the case in which the effect device for adding feedback effect is installed as an independent unit.

In the electronic stringed instrument, the feedback operator may comprise a setting operator that sets the level of the feedback effect. This operator is installed at a position in the main body of the stringed instrument where the performer can easily operate while performing. Therefore, the performer can arbitrarily perform the feedback performance with an appropriate level in an arbitrary part of the music being performed regardless of the performer's own standing position (the position with respect to the amplifier, etc.).

Moreover, in the electronic stringed instrument described above, the feedback operator may comprise an operator capable of switching on and off of the feedback effect. For instance, the operator capable of switching on and off of the feedback effect may use various sensors and switches, such as, a pressure sensor, a push switch, an electrostatic touch switch, and the like. This operator may be installed at a position in the main body of the stringed instrument that can be easily operated while the player is performing. Therefore, the performer can switch on and off the feedback performance at any time while performing, regardless of own standing position.

Moreover, in the electronic stringed instrument of certain embodiments, the parameter of the filter device to pass the tone signal input from the input device is set according to the pitch detected by the pitch detection device. Also, the level of the tone signal output from the filter device and/or the level of the tone signal input to the filter device are detected by the level detection device. And, the level of the tone signal output from the output device to the outside is controlled according to the level detected by the level detection device. Therefore, the feedback performance can be stably carried out.

Embodiments are described with reference to the accompanying drawings. FIGS. 1-5 show a first embodiment of the embodiments.

FIG. 1 is a front view showing an electronic guitar 100 that is one embodiment of an electronic stringed instrument of the invention. The electronic guitar 100 of the embodiment is composed in a manner that the feedback performance can be done arbitrarily and stably regardless of the standing position of the performer.

As shown in FIG. 1, the electronic guitar 100 has a body 102, a neck part 103 attached to the body 102, and a head part 104 connected to the neck part 103.

A bridge 106 is provided in the body 102. One ends of six strings 105 are attached to the bridge 106. The other ends of these strings 105 are attached to pegs installed in the head part 104. The strings 105 are stretched over the front surface side of the body 102. The bridge 106 is installed in a manner moveable about a center axis (not shown), and biased in a direction in which the strings 105 are stretched by a spring (not shown) in the normal state.

The body 102 is provided with pickups 107, 108 and 109 that detect vibration of the six strings 105, and output string signals as tone signals.

Among the three kinds of the pickups 107, 108 and 109, the pickup 107 that is the nearest to the bridge 106 comprises a rear pickup, and the pickup 109 that is remotest from the bridge 106 comprises a front pickup. The pickup 108 located between the pickup 107 and the pickup 109 comprises a center pickup. The pickups 107, 108 and 109, may comprise electromagnetic type pickups that electromagnetically detect the vibration of the strings 105. However, other types of pickups may be used, without any particular limitation to the above.

Figure 2A:
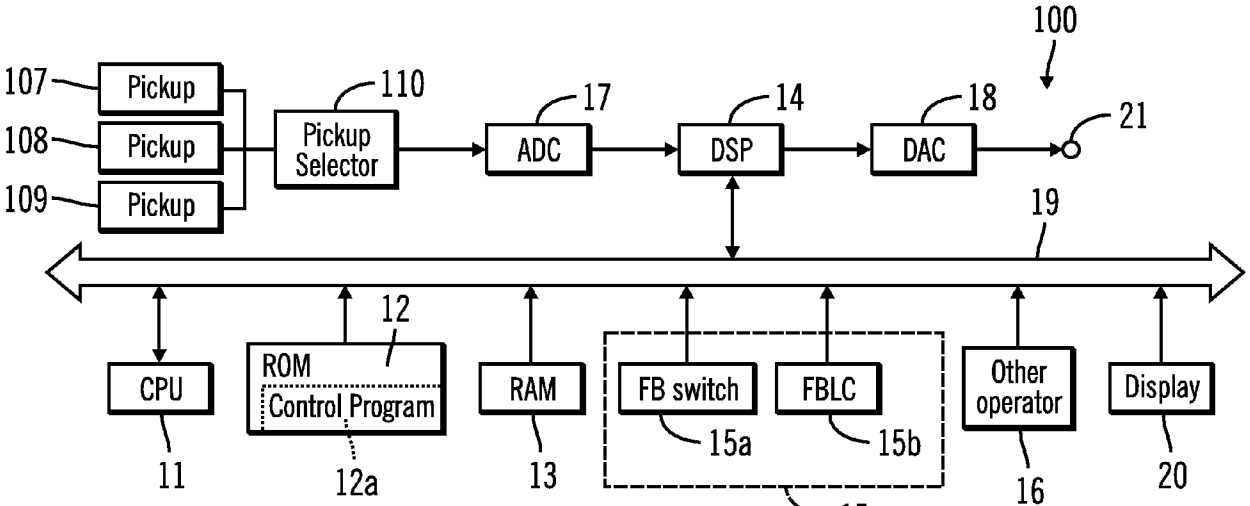
FIG. 2(*a*) is a block diagram showing the composition of the electronic guitar.
Figure 2B:
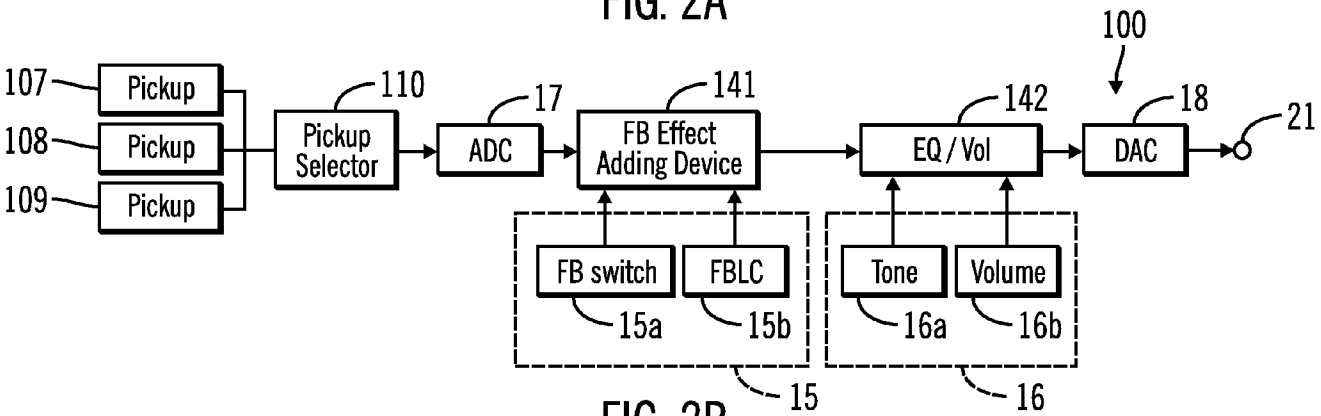

A jack 21 (see FIG. 2(*a*)), that takes out the output signal based on the string signal output from each of the pickups 107, 108 and 109 outside, is installed on the body 102. The output signal based on the string signal (the string signal as is, or the string signal with the effect added) is emanated from the guitar amplifier (the speaker) (not shown) via a cable 120 connected to the jack 21.

A pickup selector 110 in a lever switch, rotary operation knobs 111-114, a touch switch 115, and a tremolo arm 116 are set up in the body 102, as shown in FIGS. 1, 2(*a*), and 2(*b*).

The pickup selector 110 selects one of the pickups to be used when performing among the three kinds of the pickups 107, 108 and 109. The pickup selector 110 is used to select a pickup among the three pickups 107, 108 and 109, to be used during performance. The performer operates the pickup selector 110 to select a desired pickup from among the pickups 107, 108 and 109.

The operation knobs 111 and 112 each constitute a tone 16*a* (see FIG. 2(*b*)) that sets a timbre (tone). The performer rotationally operates the operation knob 111, whereby the timbre of the front pickup 109 can be adjusted. On the other hand, by rotationally operating the operation knob 112, the performer can change the timbre of the center pickup 108. The operation knob 113 may comprise a volume 16*b* (see FIG. 2(*b*)) that sets a volume (master volume). By rotationally operating the operation knob 113, the performer can adjust the volume.

The touch switch 115 is a touch switch of static electricity type (electrostatic capacity type), and comprises a feedback switch 15*a* (FB switch) (see FIG. 2(*a*)) that switches on and off the feedback effect. When the performer touches the touch switch 115, the electrostatic capacity sensor, that comprises a switch part of the FB switch 15*a*, detects a change in the electrostatic capacity, and the detection result is output to CPU 11 (see FIG. 2(*a*)). CPU 11 receives the detection result, and outputs an instruction to turn on the feedback effect to the feedback effect device (FB effect adding device) 141 (see FIG. 2 (*b*)). As a result, while the performer touches the touch switch 115, the feedback performance in which the feedback effect is added to the output sound can be performed. The feedback effect may be switched on and off each time the touch switch 115 is touched.

A feedback indicator 117 is an LED indicator that lights when the feedback effect is turned on, and goes off when the effect is turned off.

The tremolo arm 116 has an arm 116*a* and may be connected with the bridge 10 by a screw. By operating the tremolo arm 116 in a manner to bring closer to the body 102, the bridge 106 swings around the axis (not shown) as a center, whereby the tension added to the strings 105 can be weakened. Therefore, the pitch can be changed up and down by bringing the tremolo arm 116 closer to or away from the body 102.

The tremolo arm 116 also comprises the FB switch 15*a*. Specifically, the arm 116*a* is formed from an electroconductive material (for instance, metal, electroconductive polymer, etc.), and comprises a detection part of the FB switch 15*a*. The electrostatic capacity sensor, that comprises the switch section of the FB switch 15*a*, detects a change in the electrostatic capacity when the performer touches the arm 116*a*, and the detection result is output to CPU 11.

CPU 11 receives the detection result, and outputs an instruction to turn on the feedback effect to the feedback effect device (FB effect adding device) 141 (see FIG. 2(*b*)). As a result, the feedback performance can be executed while the performer is touching the arm 116*a*.

Therefore, according to certain electronic guitar 100 embodiments, while touching the arm 116*a*, the performer can perform the feedback performance while giving vibrato by bringing the tremolo arm 116 closer to and away from the body 102. Moreover, only the feedback effect can be turned on without adding vibrato, by maintaining the state in which the tremolo arm 116 is lightly touched without applying force.

The arm 116*a* is electrically insulated from the bridge 106 in the connected part with the bridge 106. As a result, the FB switch 15*a* and the strings 105 are electrically insulated from each other, and the feedback effect is prevented from turning on upon the player's touching the strings 105. In embodiments where the bridge 106 is formed from an insulator, the FB switch 15*a* and the strings 105 can be insulated electrically.

The operation knob 114 comprises a feedback level control operator (FBLC=Feed Back Level Controller) 15*b* (See FIG. 2(*a*)) that adjusts (sets) the level of the feedback effect. More specifically, the operation knob 114 comprises an operation part of the FBLC (15*b*). When the performer rotationally operates the operation knob 114, a variable resistor, that is the detection part of the FBLC (15*b*), detects the amount of the operation (amount of the rotation) by the operation knob 114, and outputs an electric signal corresponding to the detected amount of the operation to CPU 11. CPU 11 controls the level of the feedback effect based on the electric signal output from the FBLC (15*b*).

The operation knob 114 also comprises the FB switch 15*a*. Specifically, the operation knob 114 may be comprised of electroconductive material (for instance, metal, electroconductive polymer, etc.), and comprises a detection part of the FB switch 15*a*. The operation knob 114 is electrically connected with a case (not shown in the figure) that accommodates a rotation shaft (not shown in the figure) that can be turned by rotating the operation knob 114 and the detection part of the FBLC (15*b*). The case is connected with an electrostatic capacity sensor that comprises the switch of the FB switch 15*a*. The electrostatic capacity sensor detects a change in the electrostatic capacity when the performer touches the operation knob 114, and the detection result is output to CPU 11. CPU 11 receives the detection result, and outputs an instruction to turn on the feedback effect to the FB effect adding device 141. As a result, while touching the operation knob 114, the performer can perform the feedback performance. Therefore, according to the electronic guitar 100 of the embodiment, the performer can adjust the level of the feedback effect by pinching and operating (rotating) the operation knob 114 while performing the feedback performance.

The variable resistor (including the terminals), that is the detection part of the FBLC (15*b*), is electrically insulated from the case that accommodates the detection part. Therefore, even when the case that accommodates the detection part (variable resistor) of the FBLC (15*b*) and the switch part (electrostatic capacity sensor) of the FB switch 15*a* are electrically connected, sensing of the amount of operation by the FBLC (15*b*) is not influenced. In one embodiment, the operation knob 114 or the rotation shaft has electro-conductivity and the switch part of the FB switch 15*a* may be electrically connected to the operation knob 114.

According to the electronic guitar 100 of the embodiment, by touching the touch switch 115, the arm 116*a* of the tremolo arm 116 or the operation knob 114, the performer can add the feedback effect while they are being touched.

In other words, by touching these parts 115, 116*a* and 114, the performer can perform the feedback performance. On the other hand, unless these parts 115, 116*a* and 114 are touched, the feedback effect is not added and the feedback performance is not performed. Therefore, the performer can arbitrarily switch on and off the feedback performance at any time while performing, regardless of the standing position of the performer. Moreover, the state of on/off of the feedback effect can be easily checked visually by the display on the feedback indicator 117. Moreover, according to the electronic guitar 100 of the embodiment, the level of the feedback effect can be adjusted by operating the operation knob 114. Therefore, the performer can appropriately adjust (for example, fine-tune) the level of the feedback effect at any time during performance regardless of own standing position.

FIG. 2(*a*) is a block diagram showing the electric composition of the electronic guitar 100. The electronic guitar 100 has central processing unit (CPU) 11, Read Only Memory (ROM) 12, Random Access Memory (RAM) 13, a digital signal processor (DSP) 14, a feedback operator (FB operator) 15, other operators 16, and an indicator 20, and these parts 11-16 and 20 are connected mutually through a bus line 19.

The electronic guitar 100 also includes an analog to digital converter (ADC) 17 and a digital to analog converter (DAC) 18. ADC 17 is connected with the pickup selector 110 and DSP 14. DAC 18 is connected to DSP 14 and the jack 21. CPU 11, ROM 12, RAM 13, DSP 14, ADC 17, DAC 18, and the bus line 19 are built into the body 102 as a controller device.

From analog string signals supplied from each of the pickups 107, 108 and 109, string vibration of desired one or a plurality of the pickups is selected by the pickup selector 110, converted into digital signals by ADC 17, and input to DSP 14 and processed. On the other hand, the signal processed in DSP 14 is converted into an analog signal by DAC 18 and output through the jack 21. The signal output through the jack 21 is emanated from the guitar amplifier (speaker) (not shown in the figure). A feedback loop can be formed with the strings 105 of the electronic guitar 100, the guitar amplifier (speaker) connected to the jack 21 and the acoustic space formed between them.

CPU 11 is a central control unit that controls each part of the electronic guitar 100 according to fixed value data and a control program stored in ROM 12 and RAM 13. ROM 12 is a non-rewritable memory, and stores a control program 12*a* that renders CPU 11 and DSP 14 to execute each processing, and fixed value data (not shown in the figure) referred to by CPU 11 when the control program 12*a* is executed. Each processing shown in the flow charts of FIG. 4, FIG. 5(*a*), and FIG. 5(*b*), to be described, below is executed by CPU 10 according to the control program 12*a*. RAM 13 is a rewritable memory, and has a work area (not shown in the figure) to store various data temporarily when CPU 11 executes the control program 12*a*. DSP 14 is an arithmetic unit to process digital signals.

The FB operator 15 is an operator for controlling the feedback effect. In the present embodiment, the FB operator 15 is configured with an FB switch 15*a* to switch on and off the feedback effect, and a FBLC (15*b*) for adjusting the level of the feedback effect. The other operator 16 is an operator other than the FB operator 15.

FIG. 2(*b*) is a functional block diagram showing the functions of the electronic guitar 100. The analog string signal selected by the pickup selector, as shown in FIG. 2 (*b*), is input to ADC 17. The input analog signal is converted into a digital signal by ADC 17, and supplied to the FB effect adding device 141.

The FB effect adding device 141 is a function to add the feedback effect to an original sound based on vibration of the strings 105, and it is at least achieved by the processing of DSP 14. The FB effect adding device 141 is connected with the FB operator 15 (FB switch 15*a* and FBLC 15*b*) via an analog to digital converter (not shown). When the feedback effect is turned off, the FB effect adding device 141 supplies the digital signal supplied from ADC 17 to EQ/Vol 142 in a succeeding stage as it is.

On the other hand, when the feedback effect is turned on by the FB switch 15*a*, the FB effect adding device 141 adds the feedback effect at the level corresponding to the amount of the operation of the FBLC (15*b*) to the digital signal supplied by ADC 17, and supplies the same to EQ/Vol 142 in the succeeding stage.

EQ/Vol 142 is a function to control the tone and the volume of the signal (tone signal) output from the FB effect adding device 141, and it is realized by cooperative processing with CPU 11 and DSP 14. The other operator 16 is connected with EQ/Vol 142 through the analog to digital converter (not shown). In one embodiment, the other operator 16 is configured with a tone 16*a* and a volume 16*b*. The tone 16*a* outputs an electric signal corresponding to the amount of operation of the operation knobs 111 and 112. The volume 16*b* outputs an electric signal corresponding to the amount of operation of the operation knob 113.

EQ/Vol 142 controls the digital signal supplied by the FB effect adding device 141 to have a timbre and a volume corresponding to the electric signal input from the tone 16*a* and the volume 16*b* (that is, corresponding to the operation of the operation knobs 111-113), and supplies the same to DAC 18. DAC 18 converts the digital signal input from EQ/Vol 142 into an analog signal, and output the signal through the jack 21.

Figure 3:
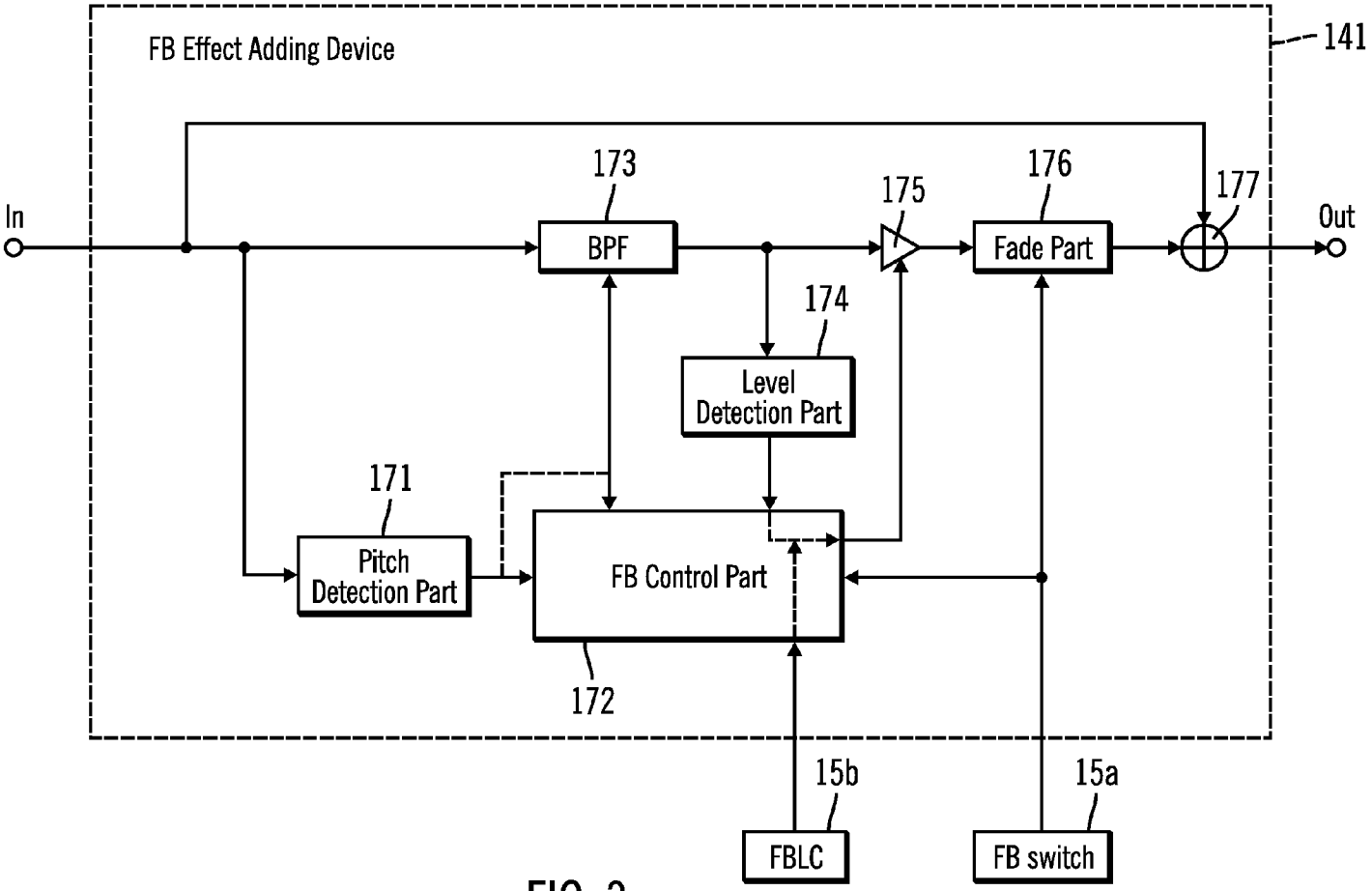
FIG. 3 is a functional block diagram showing detailed functions of a feedback effect device.

FIG. 3 is a functional block diagram showing detailed functions of the FB effect adding device 141 described above. Among the functions shown in FIG. 3, each of the parts 171, 172, 174 and 176 is a function achieved by cooperative processing done by CPU 11 and DSP 14. Each of the parts 173 and 175 is a function achieved by processing of DSP 14.

The digital signal input to the FB effect adding device 141 is supplied to the pitch detection part 171, the band-pass filter (BPF) 173 and the adder 177. The pitch detection part 171 detects the pitch of the input digital signal (that is, the pitch of the string vibration), and supplies pitch information indicative of the detected pitch to the FB control part 172.

When the feedback effect is turned on by the FB switch 15*a*, the FB control part 172 sets parameters that specify the filter characteristic to the BPF 173, based on the pitch information supplied from the pitch detection part 171. For instance, when the pitch information supplied from the pitch detection part 171 indicates the bass range, the FB control part 172 sets parameters including the center frequency, the Q value and the gain such that the feedback sound may shift to a harmonic of higher-order (for instance, the third harmonic, the fifth harmonic, etc.). Or, for example, when the pitch information supplied from the pitch detection part 171 indicates the midrange, the FB control part 172 sets parameters including the center frequency, the Q value, and the gain such that the feedback sound may shift to the second harmonic. Further, when the pitch information supplied from the pitch detection part 171 indicates the treble range, the FB control part 172 may sets parameters including the center frequency, the Q value, and the gain such that the feedback sound may be maintained at the fundamental (keynote). The parameters for each of the tone ranges may be stored, for example, in ROM 12 in advance.

BPF 173 filters and adjusts the gain of the digital signal input to the FB effect adding device 141 (that is, the digital signal of the string signal output from each pickup 107, 108, 109) and supplies the processed signal to the level detection part 174 and the multiplier 175.

The level detection part 174 detects the level of the signal output from BPF 173, and supplies level information indicative of the detected level to the FB control part 172. The FB control part 172, when the feedback effect is turned on by the FB switch 15*a*, sets a coefficient to be supplied to the multiplier 175 based on the level information supplied from the level detection part 174.

Specifically, when the level information supplied from the level detection part 174 shows that the level of the signal output from BPF 173 is below a predetermined level, the FB control part 172 sets a coefficient to raise the level. On the other hand, when the level information supplied from the level detection part 174 shows that the level of the signal output from BPF 173 exceeds the predetermined level, the FB control part 172 sets a coefficient to raise the level. When the level of the signal output from BPF 173 is too large, a coefficient to lower the level may be set.

The FB control part 172, based on the coefficient set based on the level information supplied from the level detection part 174 and the amount of the operation of FBLC (15*b*), sets the output value, and supplies the set output value to the multiplier 175. For instance, the output value may be set by multiplying the coefficient set based on the level information and the value corresponding to the amount of the operation of FBLC (15*b*). According to the embodiment, it is assumed that the value corresponding to the amount of the operation of FBLC (15*b*) is a value within the range from 0 to a prescribed value greater than 1. Therefore, when the value corresponding to the amount of the operation of FBLC (15*b*) is one, the coefficient set based on the level information supplied from the level detection part 174 is supplied to the multiplier 175 as an output value. On the other hand, when the value corresponding to the amount of the operation of FBLC (15*b*) is zero, zero is supplied to the multiplier 175 as an output value. The setting of the output value may be configured, without being limited to the above-described multiplication, such that a predetermined value decided according to the amount of the operation of FBLC (15*b*) may be added to or subtracted from the coefficient set based on the level information.

The multiplier 175 multiplies the signal output from BPF 173 by the output value supplied by the FB control part 172 to adjust the level of the output signal from BPF 173, and supplies the processed signal to a fade part 176. The fade part 176 fades in or fades out the output signal from the multiplier 175 according to the state of the operation of the FB switch 15*a*, and supplies the signal to the adder 177. Concretely, when the feedback effect is switched from off to on by the FB switch 15*a*, the fade part 176 increases the level of the signal output from the multiplier 175 with the passage of time, and supplies the signal to the adder 177. On the other hand, when the feedback effect is switched from on to off by the FB switch 15*a*, the fade part 176 decreases the level of the signal output from the multiplier 175 with the passage of time, and supplies the signal to the adder 177.

The adder 177 adds the digital signal input to the FB effect adding device 141 (that is, the digital signal of the string signal output from each of the pickups 107, 108, 109) and the signal supplied from the multiplier 175 through the fade part 176. Therefore, when the feedback effect is turned on by the FB switch 15*a*, the signal in which the feedback effect is added to the string signal detected by each of the pickups 107, 108 and 109, is output through the adder 177. As a result, the tone in which the feedback effect is added to the original sound based on the vibration of the strings 105 is emanated from the guitar amplifier (speaker) (not shown in the figure). According to the FB effect adding device 141, because the FB control part 172 controls the level of the feedback sound output outside according to the level of the signal output from BPF 173, attenuation of the level of the signal output from the guitar amplifier to an outside acoustic space can be suppressed, and therefore sustain can be obtained, so that the vibration of the strings 105 of the electronic guitar 100 can be stably maintained.

Figure 4:
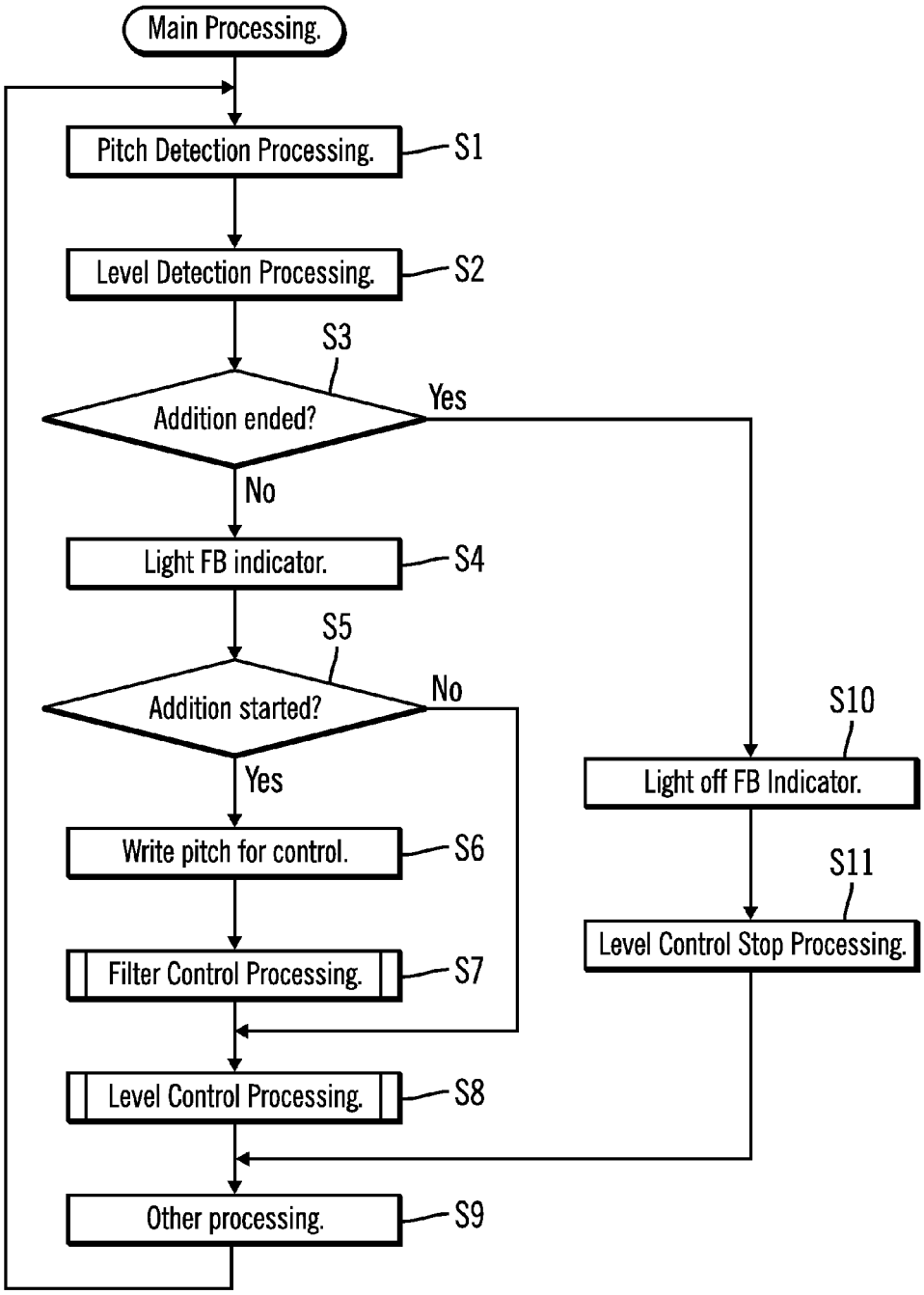
FIG. 4 is a flow chart showing a main processing executed by CPU.

Next, referring to FIG. 4 and FIG. 5, the processing executed by CPU 11 of the electronic guitar 100 having the above-described composition will be described. FIG. 4 is a flow chart showing a main processing executed by CPU 11. The main processing is started when the power supply is turned on to the electronic guitar 100, and repeatedly executed by CPU 11 while the power supply is turned on.

First, CPU 11 executes a pitch detection processing (S1).

Specifically, in the pitch detection processing (S1), CPU 11 detects the pitch of the string signal (tone signal) supplied from the pickup selector 110 with the pitch detection part 171, and stores the detected pitch P1 in a buffer for storing detected pitch installed in RAM 13.

Next, CPU 11 executes a level detection processing (S2). Specifically, CPU 11 detects the level of the output signal from BPF 173 with the level detection part 174, and stores the detected level in a buffer L1 for storing detected level installed in RAM 13.

Next, CPU 11 judges as to whether the feedback effect (FB effect) is added (S3). When the feedback effect is turned on by the FB switch 15*a*, CPU 11 determines that the feedback effect is added (S3: No), lights the FB indicator 117 (S4), and shifts the processing to S5.

In S5, when the feedback effect is newly switched on, CPU 11 determines that the feedback effect addition began (S5: Yes), and shifts the processing to S6. Or, when the difference between the pitch (P1) detected in S1 and stored in the detection pitch storage buffer and the pitch (P2) stored in the control buffer used for feedback effect control is greater than a predetermined value (for instance, three semitones), CPU 11 determines that a plucking performance has been newly carried out, and judges that the feedback effect addition has begun (S5: Yes), similar to the case where the feedback effect is newly switched on, and shifts the processing to S6.

In S6, CPU 11 writes the latest pitch P1 detected in S1 and stored in the detection pitch storage buffer to the buffer (which is also provided in RAM 13) that stores the pitch P2 for control that is used for the feedback effect control.

After the processing in S6, CPU 11 executes a filter control processing that sets parameters to BPF 173 (DSP14) (S7). The filter control processing (S7) may comprise a processing that sets, to BPF 173, parameters corresponding to the frequency band to which the detected pitch belongs. Details of the processing will be described later referring to FIG. 5.

CPU 11 executes a level control processing (S8) for controlling the level of the feedback sound output outside according to the level information stored in the detection level memory buffer in S2, and the amount of operation of the FBLC (15*b*). Processing of the level control processing (S8) is described later with reference to FIG. 5(*b*).

CPU 11 executes other processing and returns the processing to S1 (S9). The other processing (S9) includes, for instance, a processing that renders the fade part 176 to execute fade-in or fade-out of the signal output from the multiplier 175 according to the state of operation of the FB switch 15*a*, and the like.

In S5, if CPU 11 determines that it is not at the beginning of adding the feedback effect (S5: No), this indicates that the feedback performance is continuously being executed. In this case, the CPU 11 shifts the processing to S8, and executes the level control processing.

Moreover, in S3, if CPU 11 judges that the feedback effect (FB effect) is not added (S3: Yes), CPU 11 turns off the FB indicator 117 (S 10) and executes a level control termination processing that stops the level control by the level control processing in S7 (S11). After the processing S11, CPU 11 shifts the processing to S9.

Figure 5A:
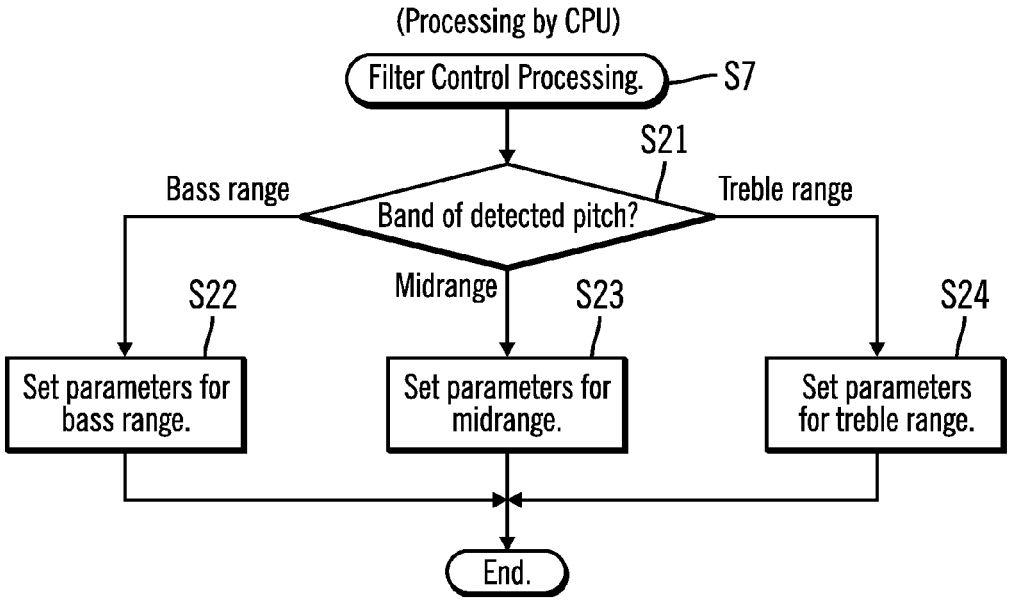
FIGS. 5(*a*) and 5(*b*) are flow charts showing a filter control processing and a level control processing executed in the main processing of FIG. 4, respectively.
Figure 5B:
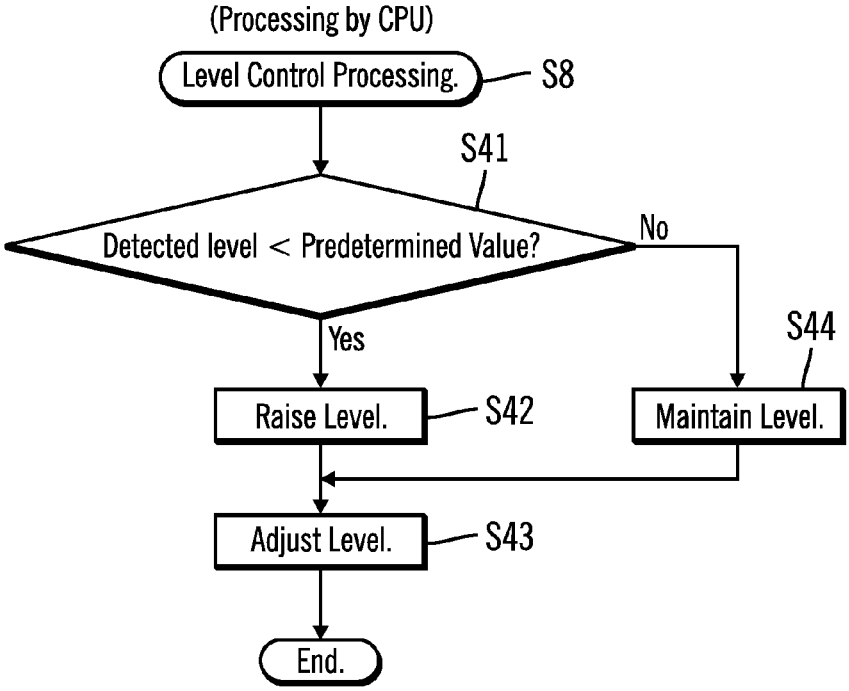

FIG. 5(*a*) is a flow chart showing the filter control processing (S7) described above. First, CPU 11 determines the frequency band of the pitch P2 used for the feedback effect control stored in the buffer in RAM 13 (S21).

When the pitch P2 belongs to a bass range (S21: bass range), CPU 11 sets parameters for the bass range to BPF 73 (S22), and ends this processing. On the other hand, when the pitch P2 belongs to a midrange (S21: midrange), CPU 11 sets parameters for the midrange to BPF 173 (S23), and ends this processing. Also, when the pitch P2 belongs to a treble range (S21: treble range), CPU 11 sets parameters for the treble range to BPF 173 (S24), and ends this processing.

FIG. 5(*b*) is a flow chart showing the level control processing (S8) described above. CPU 11 judges as to whether the detected level L1 is less than a predetermined level (S41). In S41, if the detected level L1 is less than the predetermined level (S41: Yes), CPU 11 sets a coefficient that raises the level of the signal at the multiplier 178, and shifts the processing to S43.

On the other hand, in S41, if the detected level L1 exceeds the predetermined level (S41: No), CPU 11 sets a coefficient that maintains the level of the signal at the multiplier 178 (S44), and shifts the processing to S43.

In S43, CPU 11 sets an output value based on the coefficient set according to S43 or S45 and the amount of operation of FBLC (15*b*) to adjust the level of the signal to be output from the multiplier 175 (S43). After the processing in S43, CPU 11 ends the present processing.

In a first embodiment when the electronic guitar 100 includes a built-in FB effect adding 141, as described above, on and off of the feedback effect can be freely switched if necessary by operating the FB switch 15*a*. Therefore, the performer can arbitrarily switch on and off the feedback performance at any time during performance regardless of own standing position.

Moreover, with the electronic guitar 100 of certain embodiments, the level of the feedback effect can be freely changed if necessary by operating FBLC (15*b*). Therefore, the performer can appropriately adjust the level of the feedback effect at any time during performance regardless of own standing position.

Moreover, with the electronic guitar 100 of certain embodiments, because the FB operator 15 (FB switch 15*a* and FBLC 15*b*) is installed in the main body of the electronic guitar 100, the setting relating to the feedback effect can be more easily done, compared with the case where the effect device to add feedback effect is provided as an independent unit.

In addition, upon detecting the level of the output signal from BPF 173, when the level is smaller than the predetermined level, the FB effect adding device 141 is configured to perform the control to raise the signal level. As a result, attenuation of the level of the signal to be output from the guitar amplifier to an outside acoustic space is suppressed, and therefore sustain can be obtained, the vibration of the strings 105 of the electronic guitar 100 by the feedback sound can be stably maintained. In this way, the feedback performance can be stably performed according to the electronic guitar 100 with the built-in FB effect adding device 141. Furthermore, because the level of the signal with a specific frequency characteristic that passed BPF 173 is controlled, the level of the signal with frequency characteristic that becomes the source of unpleasant sound (so-called howling) can be prevented from rising. Therefore, the feedback performance can be done while preventing generation of unpleasant sound.

Moreover, according to the FB effect adding device 141, because the level of the signal with a specific frequency characteristic that passed the BPF 173 can be maintained at some level, the feedback performance is enabled, even if it is a small volume or a low amount of gain, at which the feedback performance cannot normally be realized. Therefore, according to the electronic guitar 100 with the built-in FB effect adding device 141, the limitation imposed on the environment in which the feedback performance is carried out, for example, the use of a large-scale guitar amplifier, and the like can be eliminated. As a result, the feedback performance can be achieved with a small guitar amplifier.

Also, the FB effect adding device 141 detects the pitch of the string vibration of the strings 105 of the electronic guitar 100, and sets the filter characteristic of BPF 173 corresponding to the detected pitch. Therefore, BPF 173 outputs the signal with the frequency characteristic corresponding to the pitch of the string vibration input. If the filter characteristic of BPF 173 is set so that the signal output from BPF 173 has a frequency characteristic suitable for the feedback performance, the signal of the suitable frequency characteristic for the feedback performance can be output to an outside acoustic space through the guitar amplifier (speaker). As a result, the vibration of the strings 105 of the electronic guitar 100 due to the feedback sound can be stably maintained by the tone emanated from the guitar amplifier. According to the electronic guitar 100 with the built-in FB effect adding device 141, the feedback performance can be stably carried out in the points described above.

A second embodiment of the embodiments is described with reference to FIG. 6.

In the first embodiment described above, the switching on and off the feedback effect is done by the FB switch 15*a*, and the level of the feedback effect is adjusted (set) by FBLC (15*b*). In a further embodiment, application of the feedback effect is controlled by FBLC (15*b*) without using the FB switch 15*a*. In other words, in the embodiment of FIG. 6, the FB operator 15 does not include the FB switch 15*a*, but has the FBLC (15*b*). With respect to the description of the second embodiment of FIG. 6, different reference numerals are assigned to the same parts shown in FIG. 3 for the different configuration of FIG. 6.

In the first embodiment of FIG. 3, the determination in S3 is executed depending on the state of the FB switch 15*a*.

Figure 6:
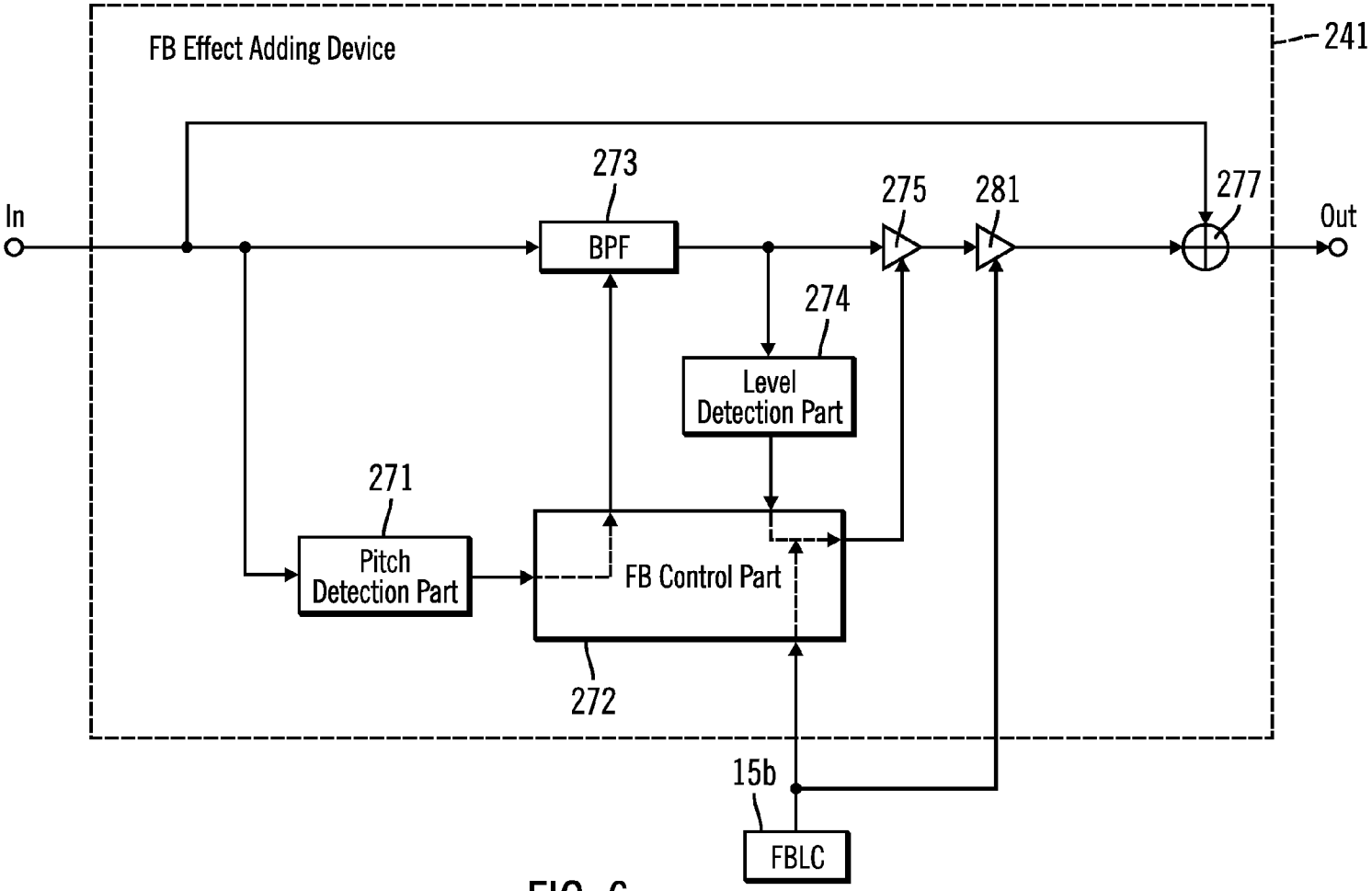
FIG. 6 is a functional block diagram showing detailed functions of a feedback effect device.

However, in the second embodiment of FIG. 6, when the value of FBLC (15*b*) is zero, CPU determines that application of the feedback effect ended (S3: Yes). Moreover, when the signal level L1 detected in S2 in the main processing is smaller than the predetermined value, CPU assumes that there is an attempt to mute or silence the performance sound, and determines that the application of the feedback effect ended (S3: Yes). When a determination is made that the feedback effect adding ended (S3: Yes), CPU11 turns off the FB indicator 117, as in the first embodiment desccribed with respect to FIG. 4 step (S10), and executes a level control termination processing (S11). In cases other than the two cases described above, when it is determined that the application of the feedback effect continues (S3: No), and the FB indicator 117 is lit on (S4), processing proceeds to S6.

In the second embodiment of FIG. 6, the determination at step S3 requires different processing than the first embodiment of FIG. 3, but other of the operations of the first embodiment of FIG. 4 are performed for the second embodiment of FIG. 6

FIG. 6 is a functional block diagram showing detailed functions of the FB effect adding device 241 in a second embodiment. The FB effect adding device 241 is a function that replaces the FB effect adding device 141 of the first embodiment of FIG. 3. The FB effect adding device 241 is equipped with a multiplier 281 in place of the fade part 176 in the FB effect adding device 141 of FIG. 3.

A signal output from the multiplier 275 is input to the multiplier 281, and the value corresponding to the amount of operation of FBLC (15*b*) is input as a coefficient. Therefore, the multiplier 281 multiplies the level of the signal output from the multiplier 275 by the coefficient corresponding to the amount of operation of FBLC (15*b*), thereby adjusting the level of the output signal from the multiplier 275, and outputs the same to the adder 277.

In the second embodiment, the level of the feedback effect can be freely changed if necessary in proportion to the amount of the operation of FBLC (15*b*). Therefore, the feedback effect can be arbitrarily operated at any time during performance regardless of own standing position.

It is noted that fade-in or fade-out of the FB effect processed sound is done by the fade part 176 at the time of on/off switching in the first embodiment of FIG. 3. In the second embodiment of FIG. 6, to turn off the effect, FBLC (15*b*) is set to zero, and therefore, when on/off of the effect is switched, fade in/fade out will be done manually, and the fade part that automatically performs fading is unnecessary.

Next, a third embodiment of the embodiments is described with reference to FIG. 7. In the first embodiment described above, the level of the output signal from BPF 173 is detected by the level detection part 174, and it is assumed a configuration in which the level of the output signal from the multiplier 175 is controlled according to the detected level. In contrast, in the third embodiment, the level of the output signal from the multiplier 375 is controlled according to the level of the signal before it is input to BPF 373. In the second embodiment, the same signs are assigned to the same parts as those of the first embodiment described above, and description thereof is omitted.

Figure 7:
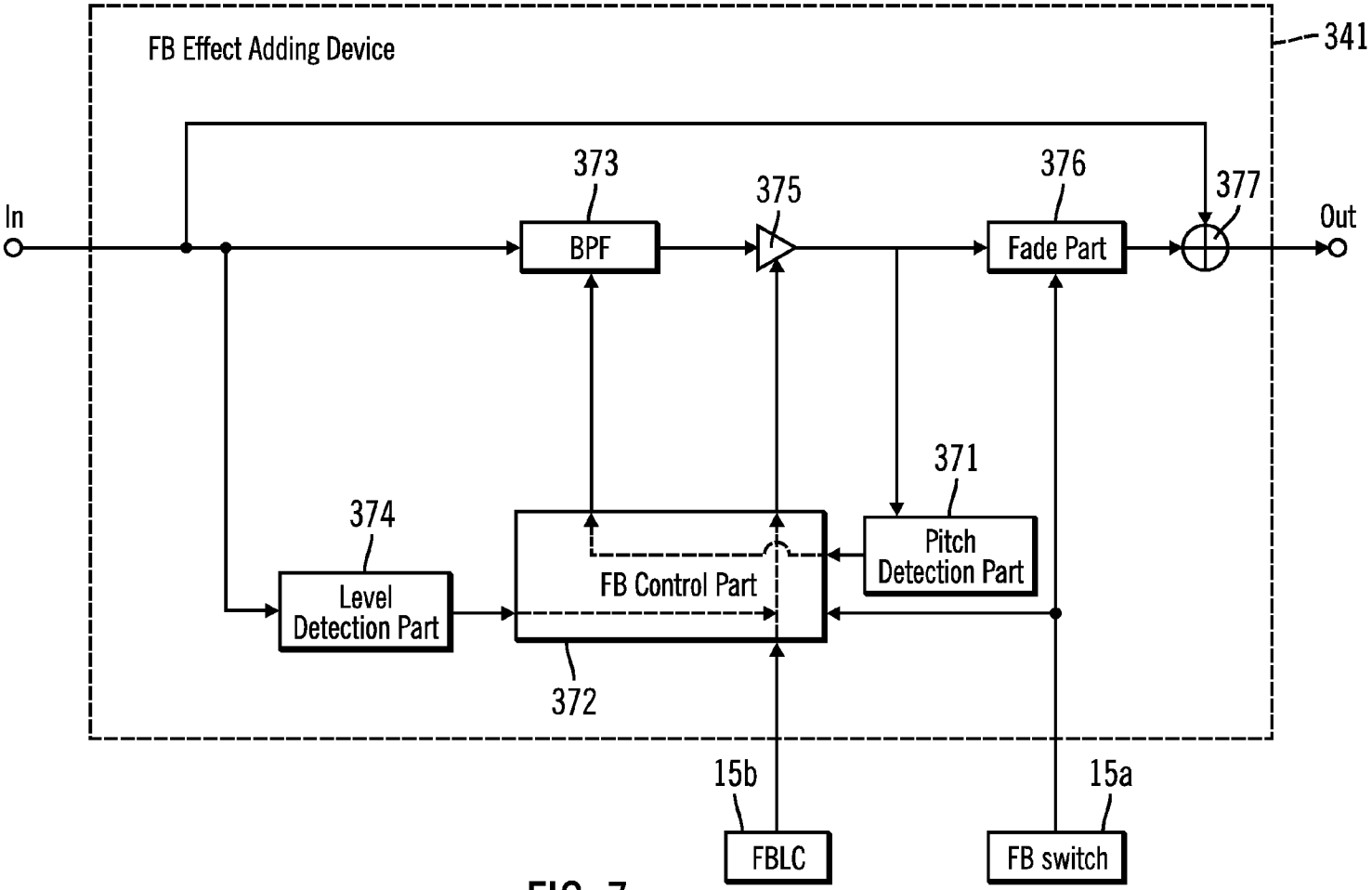
FIG. 7 is a functional block diagram showing detailed functions of a feedback effect device.

FIG. 7 is a functional block diagram showing detailed functions of an FB effect adding device 341 in the third embodiment. The FB effect adding device 341 is a function that replaces the FB effect adding device 141 of the first embodiment. As shown in FIG. 7, the digital signal input to the FB effect adding device 341 is supplied to the BPF 373, the adder 377, and the level detection part 374. The level detection part 374 detects the level of the input signal, and supplies level information indicative of the detected level to the FB control part 372. When the feedback effect is turned on by the FB switch 15*a*, the FB control part 372 sets a coefficient to be supplied to the multiplier 375 based on the level information supplied from the level detection part 374. The FB control part 372 sets an output value, based on the coefficient set and the amount of operation of FBLC (15*b*), like the first embodiment, and supplies the set output value to the multiplier 375.

In the third embodiment, the level of the output signal from BPF 373 is controlled according to the level of the signal before being input to BPF 373. Therefore, in the third embodiment, the level of the signal with a specific frequency characteristic that passed BPF 373 is controlled, such that the electronic guitar 100 with the built-in FB effect adding device 341 can stably carry out the feedback performance, similar to the first embodiment. Level control of the signal output from BPF 373 depends on the amount of operation of FBLC (15*b*), like the first embodiment. Therefore, by the electronic guitar 100 with the built-in FB effect adding device 341, the level of feedback effect can be arbitrarily adjusted regardless of the performer's standing position, similar to the first embodiment.

Moreover, as for the FB effect adding device 341 of the third embodiment, the multiplier 375 supplies the output signal to the fade part 376 and the pitch detection part 371, as shown in FIG. 7. Therefore, the pitch detection part 371 detects the pitch of the signal that passed BPF 373, and sets parameters corresponding to the detected pitch to BPF 373.

Because the signal with the frequency characteristic corresponding to the pitch of the input string signal can be output from BPF 373 even when the pitch detection by the pitch detection part 371 is performed on the signal that passed BPF 373, as in the third embodiment, the feedback performance can be stably performed, similar to the first embodiment. In the third embodiment, when the feedback effect is turned off (when the pitch detection is being performed), it is preferable that BPF 373 is may be a filter with a flat characteristic (its setting is to be reset). In the example shown in FIG. 7, the pitch of the output signal from the multiplier 375 is detected by the pitch detection part 371. However, the output signal that has been output from BPF 373, and before it is input to the multiplier 375 may be detected by the pitch detection part 71.

Next, a fourth embodiment of the invention will be described with reference to FIG. 8. In the first embodiment described above, the function to control the timbre and the volume of the tone signal (EQ/Vol 142) is achieved by the cooperative processing done by CPU 11 and DSP 14. However, in accordance with the fourth embodiment, the timbre and the volume of the tone signal are controlled by an analog circuit (analog circuit 401). In other words, in the fourth embodiment, an example in which the FB effect adding device is built into an electronic guitar of the conventional type is illustrated. Note that, in the fourth embodiment, the same signs are assigned to the same parts as those of the first through third embodiments described above, and description thereof is omitted.

Figure 8A:
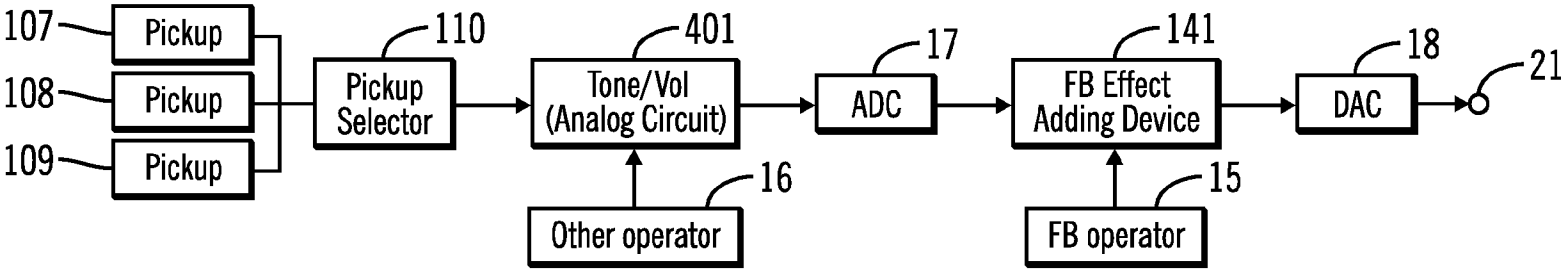
FIGS. 8(*a*) and 8(*b*) are functional block diagrams showing detailed functions of an electronic guitar.
Figure 8B:
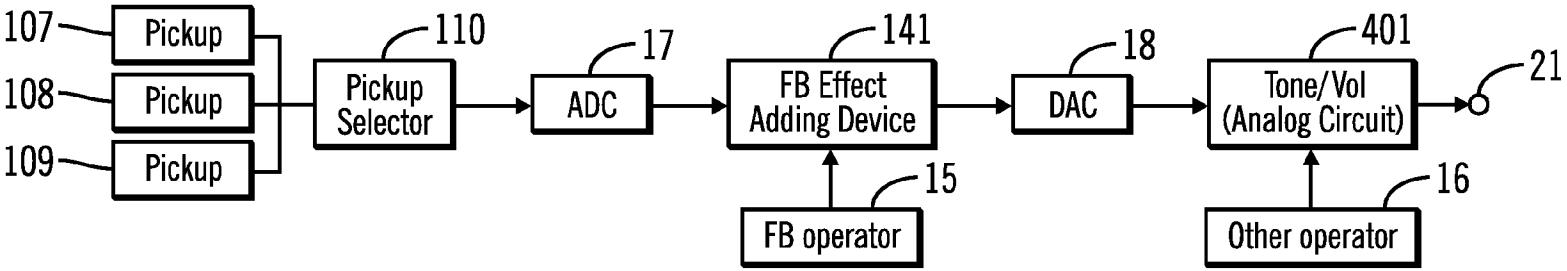

FIG. 8 (*a*) is a first example of an electronic guitar of the fourth embodiment. In the first example, the string signal (analog signal) output from each of the pickups 107, 108 and 109 is supplied to analog circuit 401. The analog circuit 401 controls the timbre and the volume of the input string signal according to inputs from other operators 16 (the tone 16*a* and the volume 16*b*), and the processed signal is supplied to ADC 17. The ADC17 converts the analog signal whose tone and volume are controlled into a digital signal, and supplies the signal to the FB effect adding device 141.

According to the input from the FB operator 15 (FB switch 15*a* and FBLC 15*b*), the FB effect adding device 141 controls application of the feedback effect, similar to the first embodiment. The FB effect adding device 141 supplies the processed signal to DAC 18, and DAC 18 converts the processed digital signal into an analog signal, and outputs the signal from the jack 21.

FIG. 8 (*b*) is a second example of an electronic guitar of the fourth embodiment. In the second example, after the application of the feedback effect has been controlled by the FB effect adding device 141, the timbre and the volume are controlled by the analog circuit 401.

Specifically, as shown in FIG. 8 (*b*), the string signal (analog signal) output from each of the pickups 107, 108 and 109 is supplied to ADC 17, converted into a digital signal in ADC 17, and then supplied to the FB effect adding device 141.

The FB effect adding device 141 controls application of the feedback effect according to the input from the FB operator 15 (FB switch 15*a* and FBLC 15*b*), like the first embodiment. The FB effect adding device 141 supplies the signal after processing to DAC 18, DAC 18 converts the digital signal after processing into an analog signal, and supplies the signal to the analog circuit 401.

The timbre and the volume of the input string signal are controlled in the analog circuit 401 according to the input from the other operator 16 (the tone 16*a* and the volume 16*b*), and the signal after processing is output from the jack 21.

As described above, by incorporating the FB effect adding device 141 in an electronic guitar of the conventional type that controls the timbre and the volume of tone signals with the analog circuit 401, the electronic guitar of the conventional type can achieve effects similar to those of the first embodiment. Note that, though the FB effect adding device 141 is illustrated as representative in FIGS. 8(*a*) and 8 (*b*), the FB effect adding device 241 or the FB effect adding device 341 may be used instead of the FB effect adding device 141.

In the above-described embodiment, the pickups 107, 108 and 109 are each an example of the string vibration detection device. The FB operator 15 is an example of the feedback operator. The FB effect giving devices 141, 241 and 341 are each an example of the feedback control device. The jack 21 is an example of the output device.

Though the present invention has been described based on the embodiments, the present invention is not limited in any way to the embodiments described above, and it can be readily presumed that various modifications and improvements can be made within the scope not departing from the subject matter of the invention.

For example, in the above-described embodiment, as the pickup 107, 108 and 109, an electromagnetic pickup that detects the vibration of the six strings 105 together without distinguishing between them, and outputs a string signal has been exemplified. However, it is possible to employ a pickup that detects the vibration of each of the six strings 105 and outputs the musical tone signal of each of the strings individually. It is also possible to pick up the string vibration by optical sensors or ultrasonic sensors. Moreover, a piezoelectric device (piezoelectric element) that may be installed on the bridge, the body or the neck to pick up the vibration may be used, instead of the electromagnetic pickup that electromagnetically picks up the string vibration. Moreover, though three pickups are exemplified in the above-described embodiment, any number of pickups may be provided, and plural different kinds of pickups may be used in combination. It is obvious that the pickup selector 10 is unnecessary if only one pickup is used or all pickup outputs are always detected.

In the above-described embodiment, as the FB switch 15 that switches on and off the feedback effect, the touch switch 115, the tremolo arm 116, and the operation knob 114 of the electrostatic type (electrostatic capacity type) are exemplified. However, various types of sensors, such as, pressure sensitive sensors, proximity sensors and like may be used.

Moreover, various types of switches that can switch two states, i.e., on and off states, such as, a push-button type switch, a toggle switch, etc. may be used as the FB switch 15*a*. Moreover, the touch switch 115 may be configured with a proximity switch, such that the feedback effect may be turned on by approaching the hand to the touch switch 115.

In the above-described embodiment, though the operation knob 114 is composed of an electroconductive material, a part of the operation knob 114 may be made to be electroconductive, and the electroconductive part may be used as the detection part of the FB switch 15*a*.

As a result, when the performer operates the operation knob 114 while touching the electroconductive part, the level of the feedback effect can be adjusted while performing the feedback performance. On the other hand, when the performer operates the operation knob 114 without touching the electroconductive part, the level of the feedback effect can be adjusted regardless of whether or not the feedback performance is carried out.

In the above-described embodiment, a rotary potentiometer with the operation knob 114 of a rotary type as the operation part and a variable resistor (not shown in the figure) as the detection part is exemplified as FBLC (15*b*). However, a linear potentiometer having a slider as the operation part may be used as FBLC (15*b*). Moreover, a sensor that can obtain a value corresponding to the operation, such as, a pressure-sensitive sensor, a proximity sensor or the like may be used as FBLC (15*b*).

In the above-described embodiment, a variable value corresponding to the amount of operation of FBLC (15*b*) is used to decide the coefficient to be input to the multiplier 75. However, it may be configured to use predetermined values stored in advance in ROM 12, etc.

In the second embodiment described above, though the value corresponding to the amount of operation of FBLC (15*b*) is supplied to the FB control part 272 and the multiplier 281. However, an operator that supplies the coefficient to the multiplier 281 may be provided independently of FBLC (15*b*). In other words, the mixing ratio between the level of the signal to which the feedback effect is added (the level of the signal output from the multiplier 275) and the level of the original string signal may be adjusted by an operator that is provided independently from FBLC (15*b*).

In the above-described embodiments, one band-pass filter (BPF 173, 273, 373) is installed to each of the FB effect adding devices 141, 241 and 341. However, a composition in which two band-pass filters or more are installed may be used. When two or more band-pass filters are installed, it is possible to use a composition that changes the number of the band-pass filters to be used depending on the range of the string signal.

In the above-described embodiment, one band-pass filter (BPF 173, 273, 373) is installed in each of the FB effect adding devices 141, 241 and 341. However, BPF 173, 373, 373 may be replaced with the one in which a high-pass filter and a low-pass filter are connected in series.

In the above-described embodiments, the input signal is filtered by the band-pass filter (BPF 173, 373, 373). However, a variety of filters may be used if the filters can pass only a specific band.

In the above-described embodiments, the filter characteristic of the band-pass filter (BPF 173, 373, 373) is changed independently for each of the three frequency bands, i.e., the bass range, the midrange, and the treble range. However, each of the band regions may be further divided, and the filter characteristic of the band-pass filter (BPF 173, 273, 373) may be changed independently for each of the further divided bands.

In the above-described embodiments, the level of the output signal from the multipliers 175, 275, 375 (that is, the level of the output signal from BPF 173, 273, 373) is controlled by FB control part 172, 272, 373 according to the level detected by the level detection part 174, 274 37. Instead of such a configuration, the level of the signal before being input to BPF 173, 273, 373 may be controlled by the FB control part 172, 272, 373 according to the level detected by the level detection part 174, 274, 374. Moreover, the FB control section 172, 272, 372 may be configured to control the level of the output signal from BPF 173, 273, 373 by adjusting the gate of BPF 173, 273, 373.

In the first and third embodiments described above, when the feedback effect are switched on and off by the FB switch 15*a*, the output signal from BPF 173, 373 is faded in or faded out in the fade part 176, 376. However, it is possible to cross-fade the digital signal input to the FB effect adding device 141, 373 and the output signal from BPF 173, 373.

In the above-described embodiment, the electronic guitar 100 is exemplified as a stringed instrument with the built-in FB effect adding device 141, 241, or 341. However, the invention is also applicable to other stringed instruments, such as, an electronic base guitar and the like.

In the above-described embodiment, though the control device including CPU 11, DSP 14, etc. is built into the body 102, it is possible to use a composition in which the controller including CPU 11, DSP 14, etc. is attached to the surface of the body 102. By providing the composition in which the controller including CPU 11, DSP 14, etc. is installed on the surface of the body 102, the FB effect adding device 141, 241 or 341 (CPU 11, DSP14) is also installed on the surface of the body 102.

In the above-described embodiment, a composition in which the signal processed in DSP 14 is output from the jack 21, after it has been converted into an analog signal by DAC 18, was illustrated. However, it may be output from the electronic guitar 100 digitally in a digital audio format, such as, SPDI/F, USB Audio, or the like without converting it into an analog signal through DAC 18, and may be connected with an amplifier, a mixer, a PC (personal computer), etc. with a digital input.

What is claimed is:

1. An electronic stringed instrument comprising:

a pickup that detects vibration of a string;

a feedback operator used to select a level of feedback effect;

a feedback control device comprising:

a filter device that passes a tone signal based on the vibration of the string detected by the pickup;

a pitch detection device that detects the pitch of the tone signal based on the vibration of the string detected by the pickup; and a setting device that sets a parameter of the filter device according to the pitch detected by the pitch detection device that controls the filter device to add a feedback effect to the tone signal based on the vibration of the string detected by the string vibration detection device and based on the selected level of feedback effect from the feedback operator; and an output device that outputs the tone signal to which the feedback effect is added by the feedback control device.

2. The electronic stringed instrument of claim 1, wherein the feedback operator comprises a pressure-sensitive sensor that changes the level of the feedback effect according to a pressurizing condition.

3. The electronic stringed instrument of claim 1, wherein the feedback operator is further used to cause a switching on and off of the feedback effect.

4. The electronic stringed instrument of claim 3, wherein the feedback operator comprises a sensor, and causes the switching on and off the feedback effect based on detection by the sensor.

5. The electronic stringed instrument of claim 4, wherein the sensor comprises an electrostatic capacity type touch sensor.

6. The electronic stringed instrument of claim 4, wherein the sensor comprises a pressure-sensitive sensor.

7. The electronic stringed instrument of claim 3, wherein the feedback operator comprises a feedback switch, and causes the switching on and off the feedback effect based on the state of the feedback switch.

8. The electronic stringed instrument of claim 7, further comprising:

a setting operator capable of changing a set value; and an operation part for operating the setting operator and having an electro conductive part, wherein the feedback switch is a switch that includes the operation part and turns on the feedback effect when the electro conductive part of the operation part is contacted by a user of the electronic stringed instrument.

9. The electronic stringed instrument of claim 1, wherein the setting device sets, to the filter device, a parameter corresponding to a frequency band to which the pitch detected by the pitch detection device belongs.

10. The electronic stringed instrument of claim 1, wherein the filter device comprises a band pass filter, and the parameter set by the setting device comprises a center frequency, a Q value and a gain of the filter device.

11. The electronic stringed instrument of claim 1, wherein the feedback control device further includes:

a level detection device detecting a level of the tone signal from the filter device; and a level control device adjusts a level of tone signal output from the output device based on the level detected by the level detection device.

12. The electronic stringed instrument of claim 11, wherein the level control device raises the level of the tone signal output from the filter device when the level detected by the level detection device is below a predetermined level, and maintains the level of the tone signal output from the filter device when the predetermined level is exceeded.

13. An electronic stringed instrument comprising:

a pickup that detects vibration of a string;

a feedback switch used to select a level of feedback effect and to cause a switching on and off of the feedback effect based on a state of the feedback switch, and including a tremolo arm including an electro conductive part to cause a turning on of the feedback effect when the electro conductive part of the tremolo arm is touched;

a feedback control device that controls to add a feedback effect to a tone signal based on the vibration of the string detected by the string vibration detection device and based on the selected level of feedback effect from a feedback operator; and an output device that outputs the tone signal to which the feedback effect is added by the feedback control device.

14. An effect device comprising:

an input device to which a tone signal based on vibration of strings of a stringed instrument is input;

a filter device that passes the tone signal from the input device;

a pitch detection device that detects a pitch of the tone signal from the filter device and/or a pitch of the tone signal to be input to the filter device;

an output device that outputs the tone signal output from the filter device;

a feedback switch that is capable of switching the feedback effect on and off; and a setting device that sets a parameter of the filter device corresponding to the pitch detected by the pitch detection device when the feedback switch is turned on, and that resets a parameter of the filter device corresponding to the pitch detected by the pitch detection device if the difference of the pitches between the pitch detected by the pitch detection device and the pitch that was used to determine the current parameter of the filter device is greater than a predetermined value.

15. The effect device of claim 14, wherein the input device comprises a touch detection part having an electrostatic capacity type touch sensor.

16. The effect device of claim 14, wherein the input device comprises a touch detection part is a pressure-sensitive sensor.

17. The effect device of claim 14, wherein the filter device comprises digital signal processing.

18. An effect device comprising:

an input device receiving a tone signal based on vibration of strings of a stringed instrument;

a filter device that passes the tone signal input from the input device;

a pitch detection device that detects a pitch of the tone signal input from the filter device and/or a pitch of the tone signal to be input to the filter device;

an output device that outputs the tone signal output from the filter device;

a feedback switch that is capable of switching on and off of the feedback effect;

a setting device that sets a parameter of the filter device corresponding to the pitch detected by the pitch detection device when the feedback switch is turned on, and that re-sets a parameter of the filter device corresponding to the pitch detected by the pitch detection device if the difference of the pitches between the pitch detected by the pitch detection device and the pitch that was used to determine the current parameter of the filter device is greater than a predetermined value;

a level detection device that detects a level of the tone signal output from the filter device and/or a level of the tone signal to be input in the filter device; and a level control device that controls the level of the tone signal output outside from the output device to have a level corresponding to the level detected by the level detection device.

19. The effect device of claim 18, wherein the input device comprises a touch detection part having an electrostatic capacity type touch sensor.

20. The effect device of claim 18, wherein the input device comprises a touch detection part having a pressure-sensitive sensor.

21. The effect device of claim 18, wherein the filter device comprises digital signal processing.

* * * * *